US005784848A

United States Patent [19]

Toscano

[11] Patent Number: 5,784,848

[45] Date of Patent: Jul. 28, 1998

[54] ROOFING SYSTEM AND SHINGLE

[76] Inventor: Philip Toscano, 265 Kings Hwy., Clarksboro, N.J. 08020

[21] Appl. No.: 744,124

[22] Filed: Nov. 5, 1996

[51] Int. Cl.[6] ..... E04D 3/24; E04D 3/36

[52] U.S. Cl. ..... 52/519; 52/523; 52/524; 52/525; 52/526; 52/527; 52/532; 52/538; 52/545; 52/546; 52/547; 52/549; 52/588.1

[58] Field of Search ..... 52/588.1, 519, 52/523, 524, 525, 526, 527, 532, 538, 545, 546, 547, 549

[56] References Cited

U.S. PATENT DOCUMENTS

| | | | |
|---|---|---|---|
| 1,515,749 | 11/1924 | Olsson | 52/523 |
| 1,819,717 | 8/1931 | Mangano | 52/545 X |
| 2,184,328 | 12/1939 | Wildman . | |
| 2,402,731 | 6/1946 | Clements . | |
| 2,592,482 | 4/1952 | Sperry . | |
| 3,377,762 | 4/1968 | Chalmers et al. . | |
| 3,412,517 | 11/1968 | Ellis et al. | 52/545 X |
| 3,811,240 | 5/1974 | Horny . | |
| 3,886,704 | 6/1975 | Mattes . | |
| 4,218,857 | 8/1980 | Vallee | 52/532 X |
| 4,384,567 | 5/1983 | Katona . | |
| 4,489,532 | 12/1984 | Ellis et al. . | |
| 4,611,451 | 9/1986 | Symbold . | |
| 5,174,092 | 12/1992 | Naden | 52/519 X |
| 5,455,099 | 10/1995 | Banner | 52/545 X |
| 5,581,968 | 12/1996 | Laurie et al. | 52/538 |
| 5,613,337 | 3/1997 | Plath et al. | 52/519 X |

*Primary Examiner*—Christopher Kent
*Attorney, Agent, or Firm*—Lennox & Murtha, P.A.

[57] ABSTRACT

A roofing system and shingle for a roof having sides and an apex is provided. A stripping is attached to the roof near the apex of the roof. A first shingle is attached to the stripping. A panel has a top edge, a bottom edge, a first side edge and a second side edge, wherein the top edge is positioned along the stripping. A bottom flange is attached to and extends along at least a portion of the bottom edge. A plate is attached to the bottom flange distal to the panel. An upper side flange is attached to and extends along at least a portion of the first side edge. A lower side flange is attached to and extends along at least a portion of the second side edge.

In accord with another aspect of the invention, a shingle for a roof is provided. A panel has a having a bottom edge, a first side edge and a second side edge. An upper side flange is integrally formed with and extends along at least a portion of the first side edge. A lower side flange is integrally formed with and extends along at least a portion of the second side edge.

23 Claims, 6 Drawing Sheets

ROOFING SYSTEM AND SHINGLE

BACKGROUND OF THE INVENTION

This invention is related to the field of building and construction. In particular, the invention is directed to a roof shingle and a roofing system.

The roof is a critical part of every building, whether residential or commercial. A roof must be capable of withstanding difficult weather conditions since it is constantly exposed. However, a roof must be light to prevent collapsing under heavy snow loads and the like. Due to the position of the roof at the top of a building, it is difficult to inspect and maintain. Consequently, it is important to construct a roof that can bear heavy loads and prolonged exposure without requiring substantial maintenance.

One particular concern with roofs is preventing water, whether from rain or snow, from getting under the roof. Typically, this problem is addressed by applying overlapping shingles to the roof from the bottom, upward. The water flows over the shingles and off the roof. However, assembling shingles properly on a roof can be a time consuming and costly process. The shingles must be aligned vertically and horizontally to insure that there are no gaps that might permit moisture leakage. Further, since roof shingles are applied from the bottom of the roof upward, the installers must walk and rest tools on the lower shingles as they install the upper shingles.

Another difficulty with current roofing systems is that they can be heavy. Typically, when an old roof needs replacing, another roof is simply applied on top of the existing roof. Due to the weight, local building codes limit the number of roofs that may be stacked. When that limit is met, the old roofs must be removed before a new roof can be installed.

Various roofing systems have been developed over the years. U.S. Pat. No. 3,377,762 is directed to a composite shingle comprising a saturated felt and asphalt base about three feet long and one foot wide, with a thin aluminum sheathe over the lower half of the base. The lower edge of the base is notched at one foot intervals.

U.S. Pat. No. 2,407,731 is directed to a building construction including units that fold over to form ramped shingles. The surfacing material on the shingle can be extended, bent over and clamped to the next unit directly above it to form a seal.

U.S. Pat. No. 2,592,482 is directed to a Bermuda-type metal shingled roof. The metal cover on the shingle is extended, bent up, and attached, such as by a nail, to the shingle directly above it to form a seal.

None of these patents resolve the issues addressed by the instant invention.

SUMMARY OF INVENTION

It is an object of the present invention to provide a roofing shingle that can be easily assembled on the roof but still prevent moisture leakage.

It is a further object of this invention to provide a roofing shingle that will form a seal with a horizontally adjacent shingle.

It is a further object of this invention to provide a roofing cover that includes shingled which are easily assembled and form seal between vertically and horizontally adjacent shingles.

In accord with one aspect of the invention, a shingle for a roof is provided. A panel has a bottom edge, a first side edge and a second side edge. A bottom flange is attached to and extends along at least a portion of the bottom edge. A plate is attached to the bottom flange distal to the panel. An upper side flange is attached to and extends along at least a portion of the first side edge. A lower side flange is attached to and extends along at least a portion of the second side edge.

Certain implementations of this aspect of the invention provide that: apertures are disposed along the plate; the panel, the bottom flange and the plate are integrally formed; the panel has a front surface and a rear surface, wherein the bottom flange extends from the rear surface; the upper side flange extends from the front surface; the lower side flange extends from the rear surface; an indent is on the panel; the indent is a rectangular depression in the panel.

In accord with another aspect of the invention, a roofing system for a roof having sides and an apex is provided. A stripping is attached to the roof near the apex of the roof. A first shingle is attached to the stripping. A panel of the shingle has a top edge, a bottom edge, a first side edge and a second side edge. The top edge is positioned along the stripping. A bottom flange is attached to and extends along at least a portion of the bottom edge. A plate is attached to the bottom flange distal to the panel. An upper side flange is attached to and extends along at least a portion of the first side edge. A lower side flange is attached to and extends along at least a portion of the second side edge.

Certain implementations of this aspect of the invention provide that: an end piece covers one side edge of the shingle; a cap is attached along the apex of the roof and covers the stripping and the top edge of the shingle; a second shingle has a second top edge, a second side edge and a side flange attached to and extending along the second side edge, wherein the second top edge is positioned along the stripping and the side flange is engaged to a side flange of the first shingle; the second shingle further comprises a second bottom edge and a second bottom flange extending along the second bottom edge, wherein the second bottom flange is engaged with the bottom flange of the first shingle; the stripping is a J-shaped member; the end piece includes a slip disposed under the first shingle and a flashing attached to the slip that extends around the roof.

In accord with another aspect of the invention, a shingle for a roof is provided. A panel has a bottom edge, a first side edge and a second side edge. An upper side flange is integrally formed with and extends along at least a portion of the first side edge. A lower side flange is integrally formed with and extends along at least a portion of the second side edge.

Certain implementations of this aspect of the invention provided that: a bottom flange is integrally formed with and extends along at least a potion of the bottom edge; a plate is attached to the bottom flange distal to the panel; the panel further comprises a front surface and a rear surface, wherein the bottom flange extends from the rear surface of the panel, the upper side flange extends from the front surface of the panel, and the lower side flange extends from the rear surface of the panel; a projection is attached to the panel near the bottom edge which is adapted to engage an adjacent shingle at a fixed position.

DESCRIPTION OF PREFERRED EMBODIMENTS

Figure 1:
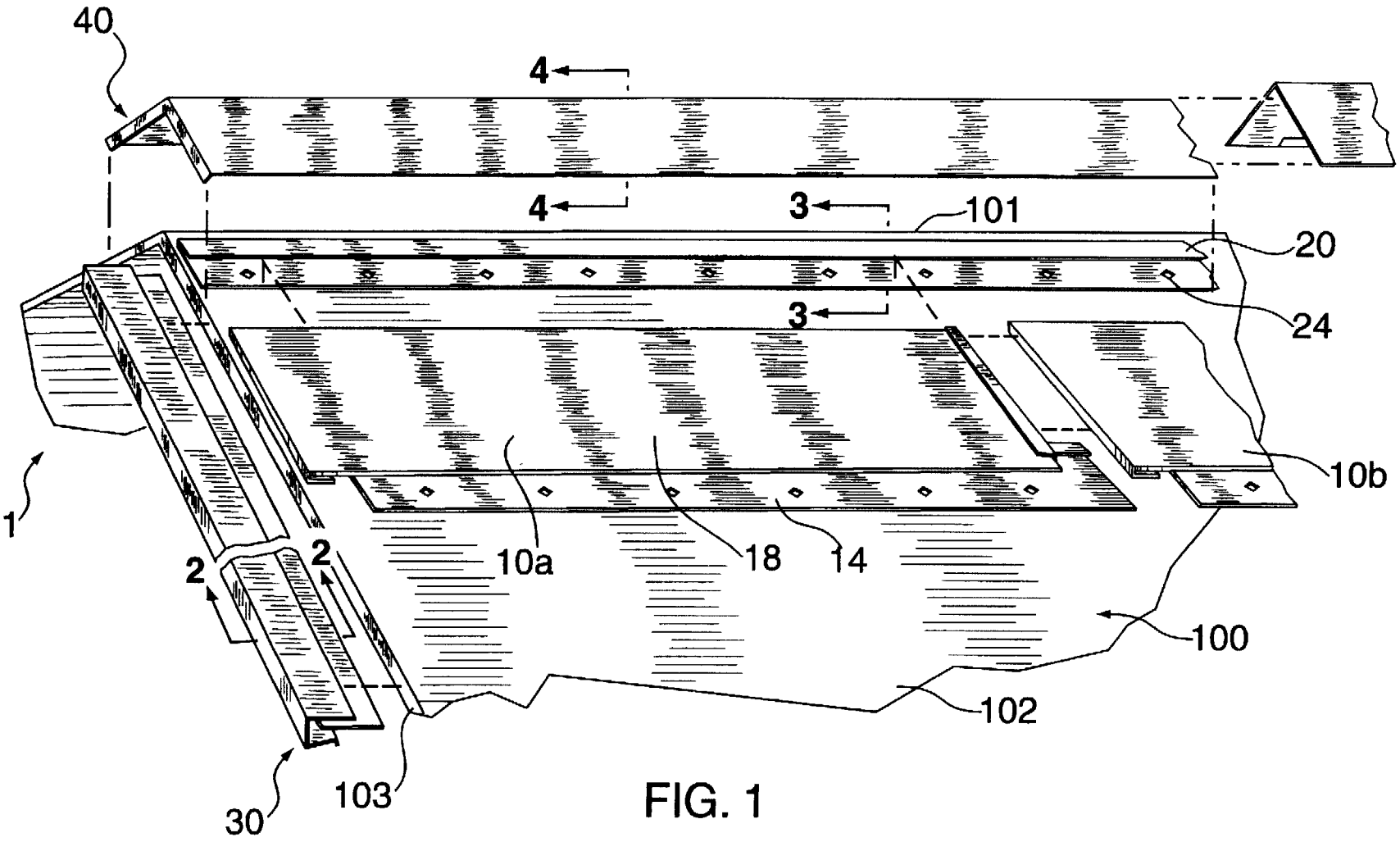
FIG. 1 is an exploded view of a roofing system in accord with an aspect of the present invention.
Figure 2:
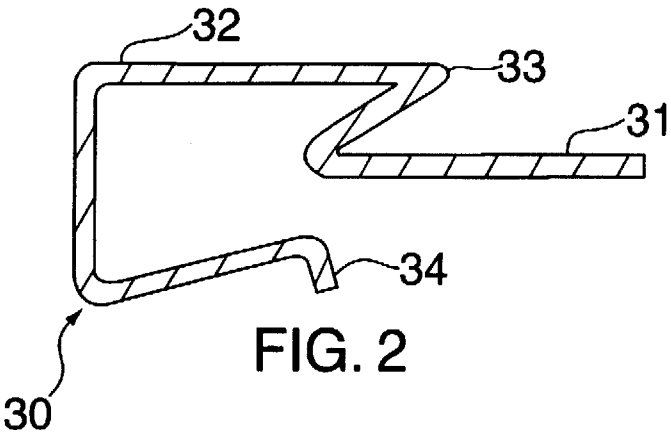
FIG. 2 is a cutaway view of an end piece along line 2—2 of FIG. 1.

Referring to FIG. 1, the roofing system 1 of an embodiment of the present invention includes a series of shingles 10*a*, 10*b* attached to a stripping 20 along the side 102 of a roof 100. An end piece 30 is attached to the side edge 103 of the roof and positioned along the edge of the shingles. A cap 40 is attached over the stripping and the top of the shingles at the apex 101 of the roof. The shingles are designed such that they interlock with adjacent shingles, both along bottom edges and along the sides. The end piece forms a flashing around the end of the roof to prevent leaking. The cap prevents water from getting beneath the shingles at the top of the roof.

Figure 5:
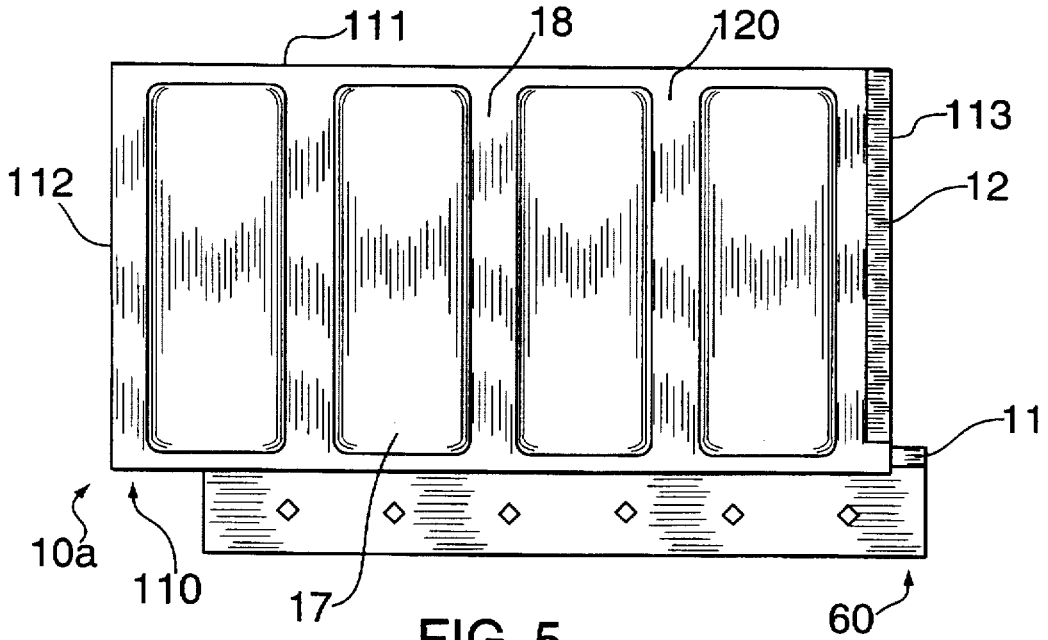
FIG. 5 is a top plan view of a shingle for use with the roofing system of FIG. 1.
Figure 6:
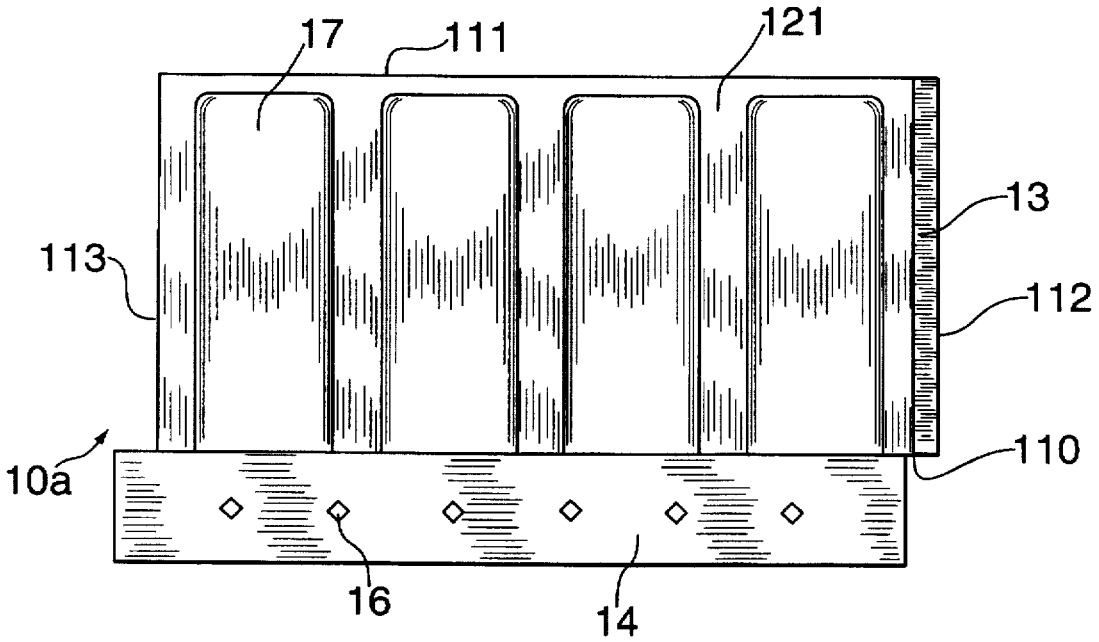
FIG. 6 is a bottom plan view of a shingle for use with the roofing system of FIG. 1.
Figure 8:
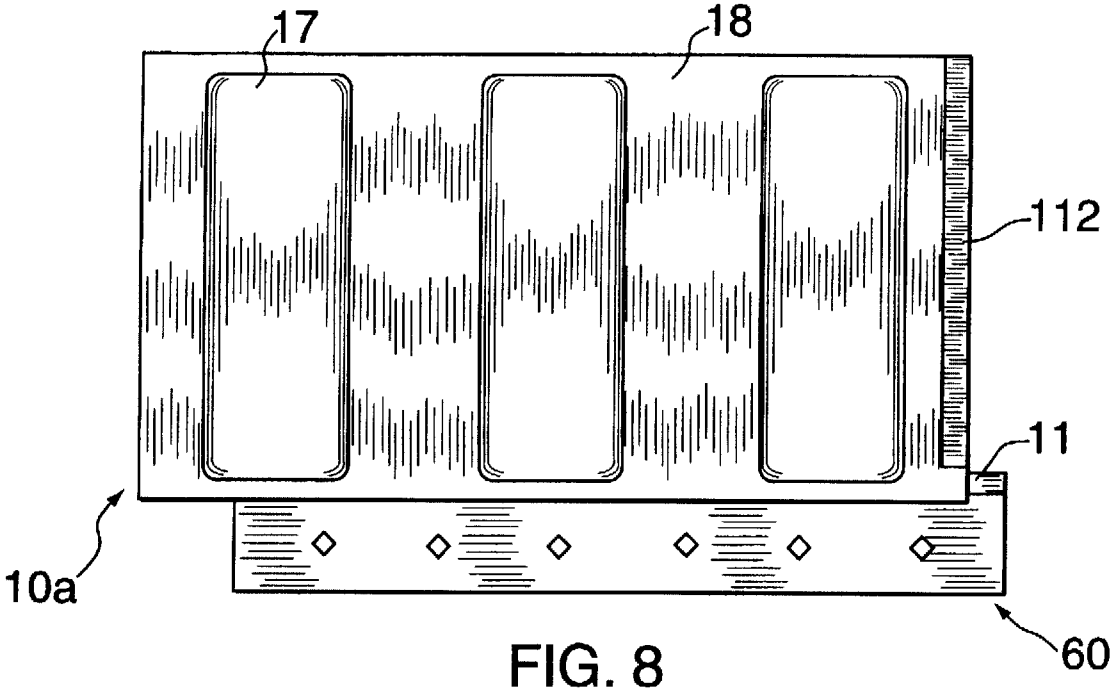
FIG. 8 is a top plan view of another shingle for use with the roofing system of FIG. 1.

Referring to FIGS. 5 and 6, the shingle (such as shingle 10*a*) includes a panel 18. Preferably, the shingle is about three feet long and one foot high and is made of a single sheet of aluminum. Of course other materials and sizes can be employed, and the shingle could be assembled from separate component parts and still practice the invention. FIG. 5 is a plan view of the front surface 120 of the shingle. FIG. 6 is a plan view of the rear surface 121 of the shingle. The panel may be flat as shown in FIG. 1. However, the panel may also be sculpted, adding dimples or corrugations to provide additional strength. Further, design features may be imprinted in the panels. For example, rectangular indents 17 may be located in the panels. As shown in FIGS. 5 and 6, four indents are located on each shingle. However, in certain applications, other numbers or arrangements of indents may be located in each panel. Three indents per panel, as shown in FIG. 8, has been found to create an aesthetically pleasing shingle.

A bottom flange 11 is attached to and extends along the bottom edge 110 of the panel 18. A plate 14 is attached to and extends along the bottom flange. The panel, bottom flange and plate can be separately formed and then assembled, or integrally formed of a single sheet. The bottom flange and the plate extend rearwardly from the rear surface of the panel and create a crevice 11*a*. The bottom flange and the plate are preferably the about same length as the panel but offset from the panel, such that a portion of the bottom flange and the plate projects beyond the side edge 113 of the plate. As discussed below, this projection 60 engages the bottom flange 11 of an adjacent shingle. Apertures 16 are located in the plate. As discussed below, nails are driven through the apertures into the roof 100, keeping the shingle on the roof but allowing some displacement of the shingle for assembly.

Figure 7:
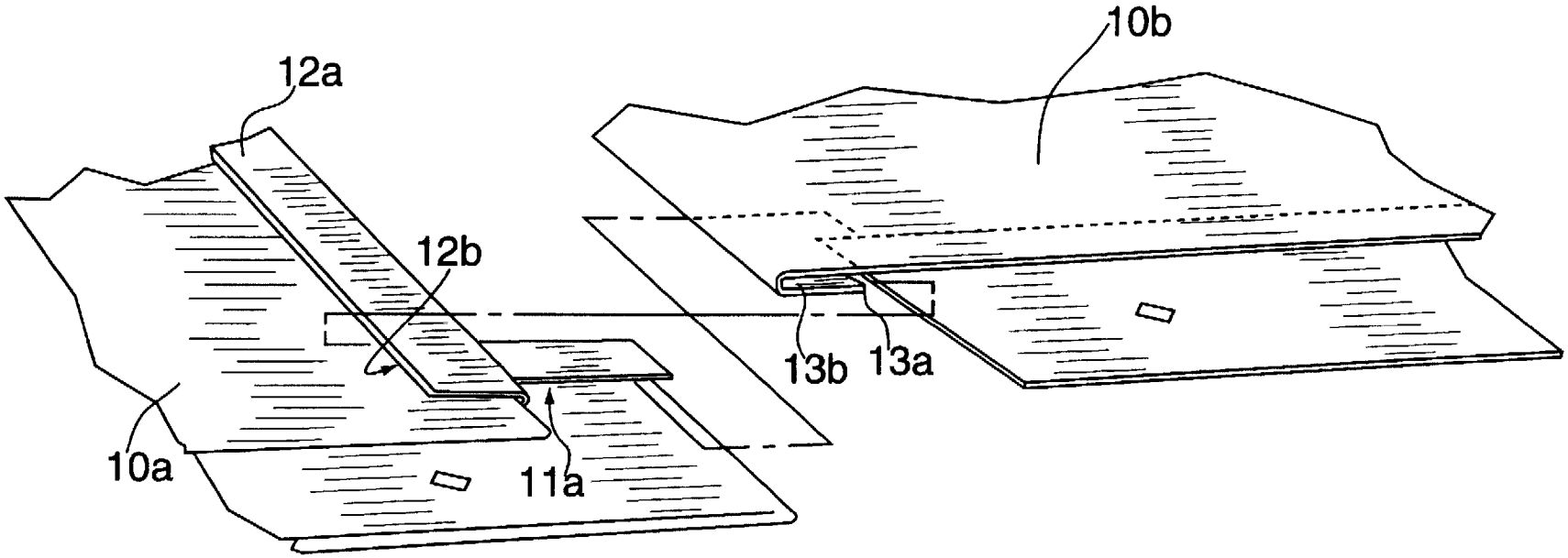
FIG. 7 is an exploded view of horizontally adjacent shingles for use with the roofing system of FIG. 1.

An upper side flange 12 is attached to and extends along the side 113 of the panel 18. The upper side flange extends forwardly of the front surface 120 of the panel. A lower side flange 13 is attached to and extends along the other side 112 of the panel. The lower side flange extends rearwardly from the rear surface 121 of the panel. Although not necessary, it is preferred that the side flanges extend nearly the entire length of the sides of the panel. Each side flange forms a tab 12*a*, 13*a*, respectively, and a slot 12*b*, 13*b*, respectively (see FIG. 7).

Figure 3:
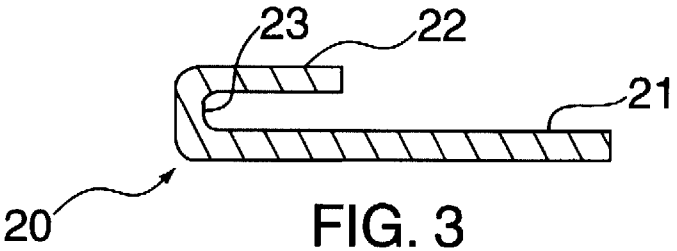
FIG. 3 is a cutaway view of a stripping along line 3—3 of FIG. 1.
Figure 4:
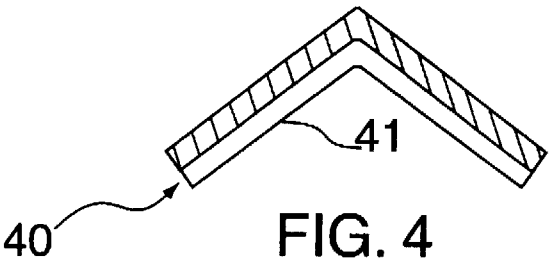
FIG. 4 is a cutaway view of a cap along line 4—4 of FIG. 1.

The stripping 20 is a J-shaped member (see FIG. 3) having a footer 21 and a top flange 22. The footer is a substantially rectangular sheet having apertures 24 to receive nails. The top flange forms a channel in which the top edge 111 of the shingle is seated.

The end piece 30 includes a slip 31 attached to a flashing 32. The slip is a rectangular member that will slide under the shingles when assembled. The flashing is angled toward the roof and then outward to form an elbow 33 covering the side edges of the shingles and the roof 100, preventing water from getting under the shingles. The cap 40 is an angled member. Trim 41 is attached at one end of the cap to prevent leaking under the cap.

To assemble the roof system of the instant invention, the stripping 20 is nailed to the roof 100 near the apex. Of course, other methods of fixing the stripping to the roof can also be employed. Since the stripping will be the base for the rest of the roof system, it is important that it be level before attaching it permanently to the roof. The slip 31 of the end piece 30 is nailed to the roof along one edge of the side 102 of the roof. The tip of the end piece is curved to form a lip 34 preventing water from passing to the roof or the side of the building.

The first shingle 10*a* is then inserted in the channel under the top flange 22 and under the elbow 33 of the end piece. When the shingle abuts the inner edge 23 of the top flange, nails are driven through the apertures 16. Preferably the nails have a large head, allowing the aperture to be large but not slip over the head. This will allow for small adjustments in the position of the shingle. A thin sheet, acting as a collar, may also be provided between the nail head and the aperture, preventing the nail head from slipping through the aperture.

The second shingle 10*b* is placed over the first shingle 10*a*. The second shingle should be set lower than the first shingle along the side 102 of the roof 100. The second shingle is then moved horizontally (leftward in FIGS. 1 and 7) until the lower side flange 13 of the second shingle engages the upper side flange 12 of the first shingle. In particular, the tab 13*a* is inserted into the slot 12*b*. At that point, the second shingle is moved vertically upward until the bottom flange of the second shingle engages the bottom flange of the first shingle. Further shingles are added as necessary to extend across the roof. The shingles need merely to be inserted into each other as described. The interlocking flanges will automatically align and seal the shingles. Of course, gaskets can be provided if desired. No time-consuming alignment is necessary. Rather, the side flanges 12, 13 and the projection 60 engage adjacent shingles at a fixed position, placing the shingles in a fixed relationship.

Once the first row of shingles are in place along the roof, the cap 40 is positioned over the apex of the roof. The trim 41 is positioned outside the shingles and the end pieces. The cap is then riveted onto the roof. Of course, other means of fixing the cap to the roof can be employed.

A second row of shingles is started below the first shingle. The top edge of another shingle is placed against the bottom edge 110 of the first shingle and nailed in place. Of course, the top edge can be inserted into the crevice 11*a*, if desired. The first shingle of the second row is preferably a different length (e.g., 1.5 feet) than the first shingle of the first row. This prevents the vertical seams of adjacent rows from aligning, which may result in leakage. The second row is continued by interlocking side flanges of adjacent shingles across the roof. The rows are added until the entire side of the roof is covered.

Figure 9:
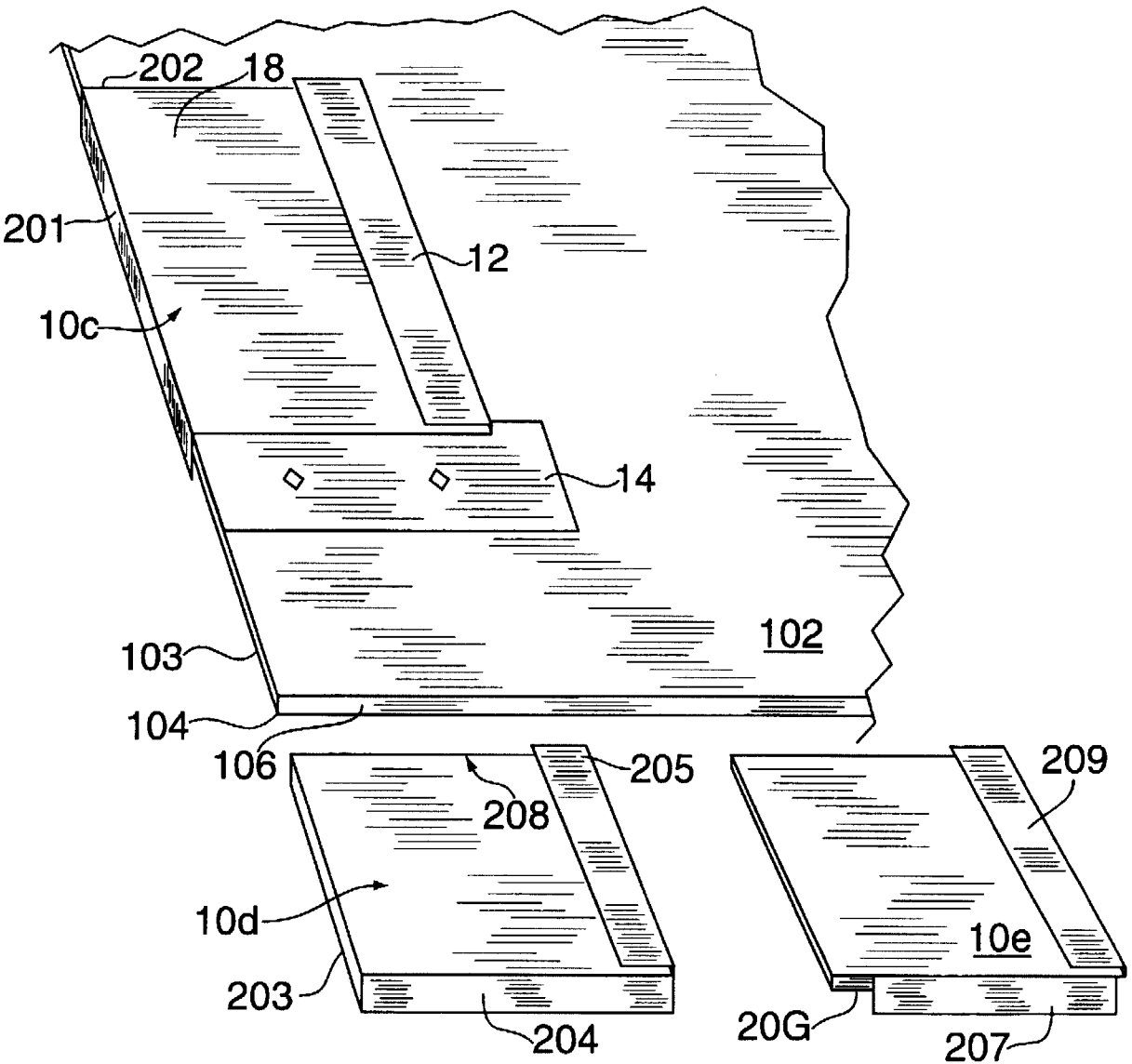
FIG. 9 is an exploded view of a roofing system in accord with another aspect of the present invention.
Figure 10:
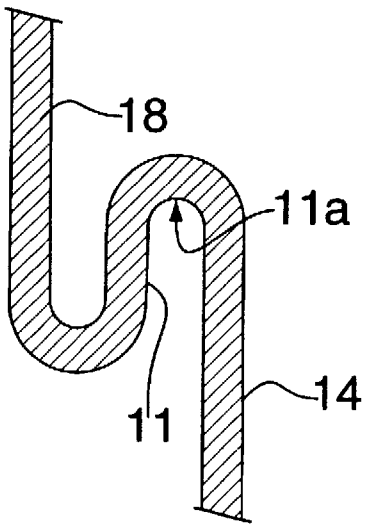
FIG. 10 is a side cut-away view of the panel, plate and bottom flange, integrally formed.

Another implementation of the invention (shown in FIG. 9) does not require a separate end piece 30. The side of an end shingle 10*c* extends straight beyond the side edge 103 of the roof. The extending side is then bent over to form a flap 201. The end of the flap may be bent up to form a lip, if desirable, to direct water away from the roof. To install the end shingle, it is placed on the side 102 of the roof with the flap aligned with the edge 103 of the roof. The end shingle is then moved upward until the top edge 202 of the end shingle 10*c* is inserted into the crevice 11*a* of the shingle directly above it (or inserted into the top flange of the stripping). The flap 203 is inserted between the edge 103 of the roof and the flap of the end shingle directly above it. The end shingle is then attached to the side 102 of the roof with nails as discussed above.

A corner shingle 10*d* is attached at the corner 104 of the roof. The corner shingle includes a side flap 203 and a bottom flap 204 that come together to form a right angle. Preferably, the bottom flap overlaps the side flap, or the side flap overlaps the bottom flap. An upper side flange 205 extends along the side of the shingle opposite the side flap. To install the corner shingle 10*d*, the side flap and the bottom flap are bent to fit the particular corner 104. The side flap is positioned along the side edge of hte roof. The bottom flap is positioned along the bottom edge of the roof. The top edge 208 is inserted in the crevice between the plate 14 and the bottom flange 11 of the end shingle 10*c* directly above it. The side flap 203 of the corner shingle 10*d* is inserted under the flap 201 of that same end shingle. Once in place, the corner shingle is riveted to the roof.

Bottom shingles 10*d* are attached to the corner shingle 10*c* along the bottom edge 106 of the side 102 of the roof to form a bottom row. The bottom shingle includes a lower side flange 206 and an upper side flange 209, similar to the shingle 10*a* of FIGS. 5 and 6. A bottom flap 207 extends along the bottom edge of the bottom shingle. To install the bottom shingle 10*d*, the bottom shingle is placed over the corner shingle 10*c* and moved horizontally until the upper flange of the corner shingle engages the lower side flange of the bottom shingle. The bottom shingle is then pushed upward until the top edge of the bottom shingle abuts the bottom edge of the shingle directly above it. Alternatively, the bottom edge can be inserted into the crevice of the shingle directly above it. Once installed, the bottom shingle is riveted to the side 102 of the roof. The bottom flange 207 is then bent down such that it is positioned along the bottom edge of the roof. A lip may be formed at the end of the bottom flap, if desired. Additional bottom shingles may be supplied, interlocking across the roof to the opposite corner, where a second corner shingle is installed.

While this invention has been described with reference to specific embodiments disclosed herein, it is not confined to the details set forth and the patent is intended to include modifications and changes which may come within and extend from the following claims. In particular, while in the embodiment discussed above the shingles are attached to the roof from the apex downward, it will be appreciated that the shingles may be applied from the bottom of the side of the roof, upward, if desired.

I claim:

1. A shingle for a roof comprising:

a panel having a bottom edge, a first side edge and a second side edge;

a bottom flange attached to and extending continuously along at least a portion of the bottom edge wherein the bottom flange is offset laterally from the bottom edge of the panel;

a plate having a flat, rectangular shape attached to the bottom flange distal to the panel and extending continuously along the bottom flange;

wherein the plate is offset laterally from the bottom edge of the panel, forming a projection which extends beyond at least one side edge of the panel and wherein the panel, the bottom flange and the plate form an S shape;

a first side flange attached to and extending along at least a portion of the first side edge; and a second side flange attached to and extending along at least a portion of the second side edge.

2. The shingle of claim 1 further comprising apertures disposed along the plate.

3. The shingle of claim 1 wherein the panel has a front surface and a rear surface, wherein the bottom flange extends from the rear surface.

4. The shingle of claim 3 wherein the first side flange extends from the front surface.

5. The shingle of claim 4 wherein the second side flange extends from the rear surface.

6. The shingle of claim 1 further wherein the panel has a sculpted surface.

7. The shingle of claim 6 wherein a rectangular indent is positioned on the panel.

8. A roofing system for a roof having sides, and an apex, a side roof edge and a bottom roof edge, the roofing system comprising:

a stripping attached to the roof near the apex of the roof; and a first shingle attached to the stripping, the first shingle having:

a panel having a top edge, a bottom edge, a first side edge and a second side edge, wherein the top edge is positioned along the stripping;

a bottom flange attached to and extending continuously along at least a portion of the bottom edge, the bottom flange being offset laterally from the bottom edge such that a portion of the bottom flange projects beyond the second side edge;

a plate fixedly attached to the bottom flange distal to the panel;

a first side flange attached to and extending along at least a portion of the first side edge; and a second side flange attached to and extending along at least a portion of the second side edge.

9. The roofing system of claim 8 further comprising an end piece covering one side edge of the panel.

10. The roofing system of claim 9 further comprising a cap attached along the apex of the roof and covering the stripping and the top edge of the panel.

11. The roofing system of claim 8 further comprising a second shingle having a top edge, a side edge and a side flange attached to and extending along the side edge, wherein the top edge of the second shingle is positioned along the stripping and the side flange of the second shingle is engaged to a side flange of the first shingle.

12. The roofing system of claim 11 wherein the second shingle further comprises a bottom edge and a bottom flange extending along the bottom edge, wherein the bottom flange of the second shingle is engaged with the bottom flange of the first shingle.

13. The roofing system of claim 11 wherein the stripping is a J-shaped member.

14. The roofing system of claim 13 wherein the end piece includes a slip disposed under the first shingle and a flashing attached to the slip that extends around the side roof edge.

15. The roofing system of claim 8 further comprising an end shingle having a flap along one side and a side flange along an opposite side, the flap being positioned along the side roof edge and the side flange being engaged to a side flange of the first shingle.

16. The roofing system of claim 8 further comprising a corner shingle having a side flange, a side flap and a bottom flap, the side flap being positioned along a side roof edge, the bottom flap being positioned along a bottom roof edge and the side flange being engaged to a side flange of the first shingle.

17. The roofing system of claim 8 further comprising a bottom shingle having a bottom flap and a side flange, wherein the bottom flap is positioned along a bottom roof edge and the side flange of the bottom shingle is engaged to a side flange on the first shingle.

18. The system of claim 8 wherein the plate extends continuously along the entire length of the bottom flange.

19. The system of claim 8 wherein the panel, the bottom flange and the plate form an S shape.

20. A shingle for a roof comprising:

a panel having a bottom edge, a first side edge and a second side edge;

a first side flange integrally formed with and extending along at least a portion of the first side edge;

a second side flange integrally formed with and extending along at least a portion of the second side edge;

a bottom flange attached to and extending continuously along at least a portion of the bottom edge; and a plate having a flat, substantially rectangular shape integrally formed with and extending continuously along the bottom flange wherein the panel, the bottom flange and the plate form an S shape.

21. The shingle of claim 20 further comprising a front surface of the panel and a rear surface of the panel, wherein the bottom flange extends from the rear surface, the upper side flange extends from the front surface of the panel, and the lower side flange extends from the rear surface of the panel.

22. The shingle of claim 20 wherein the bottom flange is offset from the bottom edge such that a portion of the bottom flange extends beyond the second side edge of the panel.

23. The shingle of claim 20 wherein the plate has a straight lower edge distal to the bottom flange.

* * * * *